US005512401A

United States Patent [19]

Sacripante et al.

[11] Patent Number: 5,512,401

[45] Date of Patent: Apr. 30, 1996

[54] POLYIMIDE-AMIC ACID TONER COMPOSITIONS

[75] Inventors: Guerino G. Sacripante, Oakville; Walter Mychajlowskij, Georgetown, both of Canada; J. Stephen Kittelberger, Rochester, N.Y.

[73] Assignee: Xerox Corporation, Stamford, Conn.

[21] Appl. No.: 394,974

[22] Filed: Feb. 27, 1995

[51] Int. Cl.[6] ..... G03G 9/087

[52] U.S. Cl. ..... 430/106; 430/109

[58] Field of Search ..... 430/106, 109, 430/110

[56] References Cited

U.S. PATENT DOCUMENTS

| | | | |
|---|---|---|---|
| 4,513,074 | 4/1985 | Nash et al. | 430/106.6 |
| 4,543,313 | 9/1985 | Mahabadi et al. | 430/109 |
| 4,560,635 | 12/1985 | Hoffend et al. | 430/106.6 |
| 5,116,939 | 5/1992 | Fletcher et al. | 528/353 |
| 5,238,768 | 8/1993 | Ong | 430/110 |
| 5,272,248 | 12/1993 | Pratt et al. | 528/353 |
| 5,340,684 | 8/1994 | Hayase et al. | 430/165 |
| 5,348,830 | 9/1994 | Sacripante | 430/109 |
| 5,348,831 | 9/1994 | Sacripante et al. | 430/109 |

OTHER PUBLICATIONS

Encyclopedia of Polymer Science and Engineering, vol. 12, 1985, John Wiley & Sons, pp. 364 to 383.

*Primary Examiner*—John Goodrow
*Attorney, Agent, or Firm*—E. O. Palazzo

[57] ABSTRACT

A toner composition comprised of a pigment and a polyimideamic acid resin.

33 Claims, No Drawings

POLYIMIDE-AMIC ACID TONER COMPOSITIONS

BACKGROUND OF THE INVENTION

This invention is generally directed to toner and developer compositions, and more specifically, the present invention is directed to developer and toner compositions containing a polyimide-amic acid resin, and process for the preparation thereof. In embodiments, there are provided in accordance with the present invention, toner compositions comprised of polyimide-amic acid resins obtained, for example, by melt condensation process, and pigment particles comprised of, for example, carbon black, magnetites, or mixtures thereof, cyan, magenta, yellow, blue, green, red, or brown components, or mixtures thereof, thereby providing for the development and generation of black and/or colored images. In embodiments, there are provided in accordance with the present invention, polyimide-amic acid resins as illustrated by following the formula

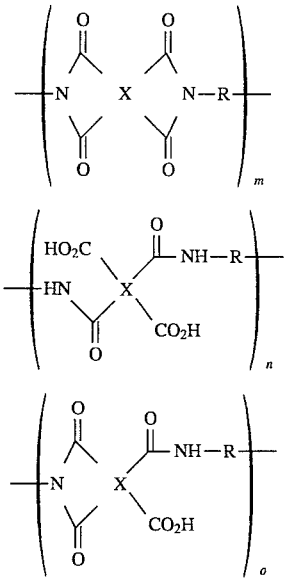

wherein m, n, and o represent random segments of the polyimide-amic acid resin, and more specifically, m is from about 0 to 99 mole percent of the resin; n is from about 0 to 99 mole percent of the resin; o is from about 1 to 100 mole percent of the resin; and the sum of m, n and o is equal to 100 mole percent of the resin; X is a tetrasubstituted aromatic or aliphatic moiety of from about 5 to about 36 carbon atoms for aliphatic, about 6 to about 36 for aromatic, and more specifically about 6 to about 30 for aromatic, and about 5 to about 36 for aliphatic, and R is an alkylene, alkyleneoxyalkylene, or poly(alkyleneoxy)alkylene. Examples of the tetrasubstituted aromatic moiety, X, include radicals of benzene, anthracene, biphenylene, diphenylene, phenanthracene, perylene, diphenyloxide, diphenylsulfoxide, diphenyl-hexafluoropropane, diphenylsulfone, benzophenone and the like, as illustrated by the following formulas

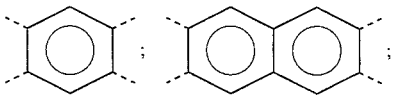

-continued

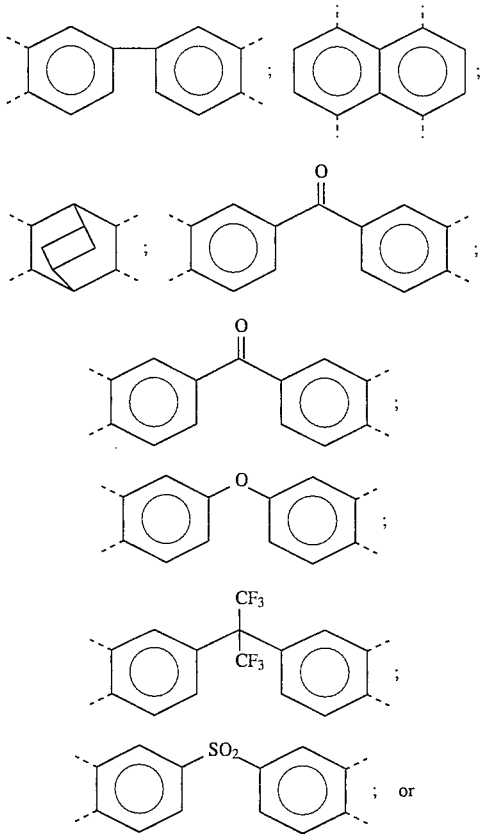

wherein the dotted lines represent bonds from the radical moiety (X) to the carbonyl groups of the aforementioned polyimide-amic acid structures. Examples of the tetrasubstituted aliphatic moiety, X, include radicals of cyclohexane, cyclopentane, 3-methyl-3-cyclohexene, bicyclo-[2,2,2]octane, 4-methyl-3-cyclohexene, 1,1',2,2'-tetramethylene ethylenediamine, mixture thereof, and the like as illustrated by the formula

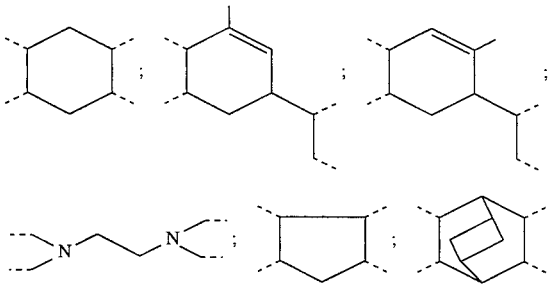

wherein the dotted lines represent bonds from the radical moiety (X) to the carbonyl groups of the aforementioned polyimide-amic acid structures. The R groups of the aforementioned polyimideoamic acid include alkylene moieties of from about 2 to 25 carbon atoms, such as ethylene, 1,2-propylene, 1,3-propylene, 1,3-butylene, 1,4-butylene, pentylene, hexylene, decylene, alkyleneoxyalkylene such as ethyleneoxyethylene, propyleneoxypropylene, butyleneoxybutylene, ethyleneoxyethyleneoxyethylene, ethyleneoxyethyleneoxyethyleneoxyethylene, propyleneoxypropyleneoxypropylene, poly(alkyleneoxy)alkylene, mixtures thereof and the like.

There are also provided in accordance with the present invention polyimide-amic acid resins containing an ester moiety, such as represented by the formula

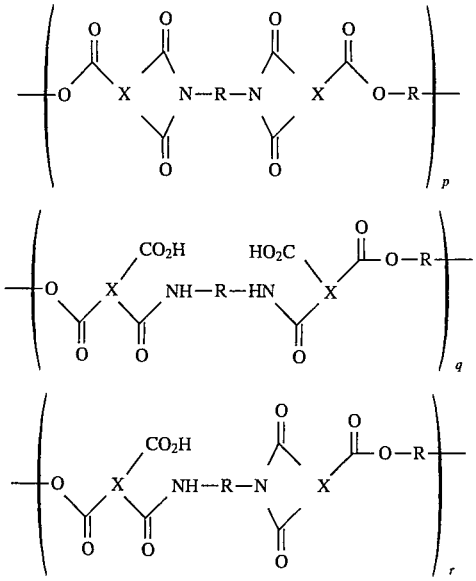

wherein p, q, and r represent random segments of the resin, and p is from about 0 to 99 mole percent; q is from about 0 to 99 mole percent; r is from about 1 to 100 mole percent; and the sum of p, q and r is equal to 100 mole percent; X is a trisubstituted aromatic or aliphatic moiety of from about 5 to 36 carbon atoms; and more specifically, X is as indicated herein, and R is an alkylene, alkyleneoxyalkylene, or poly(alkyleneoxy)alkylene. Examples of the trisubstituted moiety, X, in the aforementioned polyimide-amic acid containing an ester group, include radicals of benzene, cyclohexane, anthracene, mixtures thereof and the like, and as illustrated, for example, by the formulas

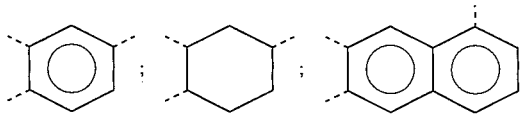

wherein the dotted lines represent bonds from the radical moiety to the carbonyl groups of the aforementioned structure of polyimide-amic acid resin containing ester group. The R groups of the aforementioned polyimide-amic acid containing ester group include alkylene moieties of from about 2 to about 25 carbon atoms such as ethylene, 1,2-propylene, 1,3-propylene, 1,3-butylene, 1,4-butylene, pentylene, hexylene, decylene, alkyleneoxyalkylene such as ethyleneoxyethylene, propyleneoxypropylene, butyleneoxybutylene, ethyleneoxyethyleneoxyethylene, ethyleneoxyethyleneoxyethylene-oxyethylene, propyleneoxypropyleneoxypropylene, poly(alkyleneoxy)-alkylene, mixtures thereof and the like.

Additionally, polyimide-amic acid resins containing moieties other than the aforementioned ester groups, such as for example, an imine moiety, a carbonate moiety or a thioester moiety, mixtures thereof and the like, and toners thereof are provided in embodiments of the present invention.

The polyimide-amic acid resins of the present invention, generally possess in embodiments a weight average molecular weight of from about 10,000 grams per mole to about 150,000 grams per mole, a number average molecular weight of from about 4,000 grams per mole to about 60,000 grams per mole, and a polydispersity, $M_w/M_n$, of from about 1.5 to about 3. Additionally, a higher polydispersity, such as from about 2.5 to about 12, can be obtained by branching or crosslinking the polyimide-amic acid resin. The branching or crosslinking of condensation resins is known, and can be accomplished by the incorporation of branching agents comprised of, for example, at least three functional groups such as hydroxyl, amine, anhydride, or carboxylic acid groups or mixtures thereof.

Furthermore, the aforementioned formulas of the polyimide-amic acid resin of the present invention can be depicted as zwitterionic forms, specifically segments n, o, q, and r, as illustrated, for example, by the formulas

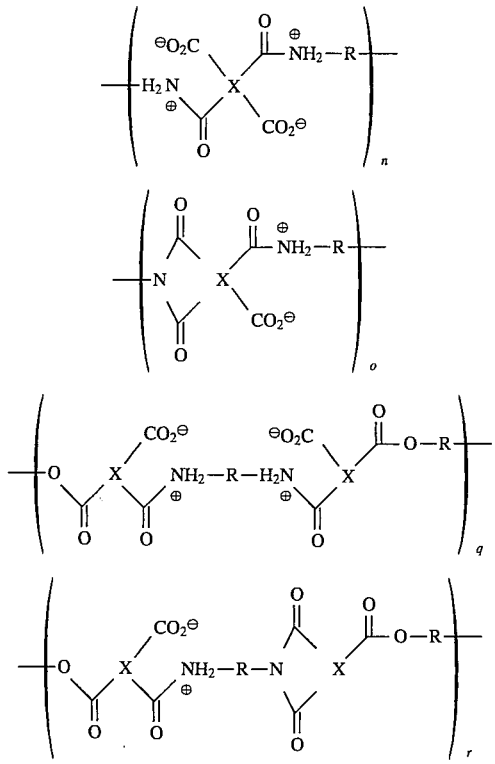

The toner compositions of the present invention in embodiments possess a number of advantages including excellent deinkability, such as in aqueous conditions, wherein the pH is from about 8 to about 10, possess low fixing characteristics such as from about 120° C. to about 145° C., excellent blocking characteristics such as from about 45° C. to about 65° C., excellent nonvinyl-offset properties, and excellent low relative humidity sensitivities.

The polyimide-amic acid of the present invention can in embodiments be generated by the reaction of a dianhydride such as 5-(2,5-dioxotetrahydrol)- 3-methyl-3-cyclohexene-1,2-dicarboxylic anhydride (I) or 5-(2,5-dioxotetrahydrol)-4-methyl-3-cyclohexene-1,2-dicarboxylic anhydride (II) available as B-4400 and B-5060, respectively, from Dai Nippon Ink Company,

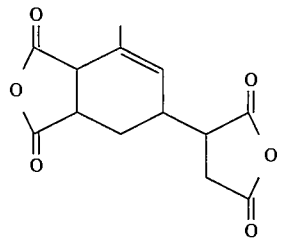

I

-continued

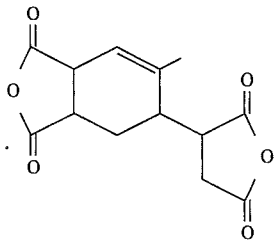

II and an aliphatic diamine like ethylenediamine or 2-methylpentamethylenediamine available as DYTEK™ from E. I. DuPont, or a diamine terminated alkyleneoxyalkylene or poly(alkyleneoxy)alkylene, such as JEFFAMINES™ available from Texaco Chemicals as JEFFAMINE D-230™, D-400™, D-700™, EDR-148™, EDR-192™ and believed to be of the following formula

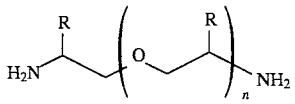

wherein

EDR-148™ n=2; R=H

EDR-192™ n=3; R=H

D-230™ n=2,3; R=$CH_3$

D-400™ n=5,6; R=$CH_3$.

The aforementioned reaction of the diamine with the dianhydride generates a polyamic acid at a temperature of from about 25° C. to about 140° C., and preferably below 100° C. in a sealed vessel. The aforementioned polyamic acid can be represented by 100 mole percent of either segment n or q of the aforementioned formulas, and on further heating above 100° C., and preferably above 145° C. to about 190° C., the imidization occurs with the liberation (or elimination) of water as the byproduct (collected by distillation), and resulting in a polyimide-amic acid, wherein the amount of water collected is proportional by mole equivalent to the sum of the n and o segments or the q and r segments of the aforementioned formulas. The collection of water can usually be enhanced by reducing the pressure of the reaction system to below atmospheric pressure up to 0.01 atmosphere. In generating the polyimide amic acid of the present invention, generally, from about 0.05 to about 0.9 mole equivalent of water is removed. Removal of 100 percent of the theoretical equivalent amount of water will result in a polyimide resin wherein the segment m or p represents 100 mole percent of the resin, and segments n, o, q, r are 0 mole percent, and thus avoided.

The polyimide-amic acid resins exhibit in embodiments a number average molecular weight of from about 2,500 grams per mole to about 100,000 grams per mole as measured by vapor phase osmometer, have a glass transition temperature of from about 45° C. to about 65° C., and more preferably of from about 50° C. to about 65° C. as measured by the Differential Scanning Calorimeter, low fixing characteristics, such as from about 125° C. to about 145° C., possess excellent deinkability such as being removed from paper in aqueous conditions at a pH of from about 8 to about 10, and with low relative humidity sensitivity such as from about 1.2 to about 3.0.

In embodiments, the polyimide-amic acid has a number average molecular weight $M_n$ of from about 1,500 to 20,000, the weight average molecular weight $M_w$ of from about 2,500 to about 100,000, and a polydispersity of from about 1.5 to about 10.

In embodiments, the polyimide-amic acid, derived from a flexible segment such as an aliphatic or poly(alkyleneoxy-)alkylene segment, of the present invention can be branched or crosslinked by utilizing an alkyltriamine or poly(alkyleneoxy)alkylene triamine, such as JEFFAMINE T-403™ available from Texaco Company, and believed to be of the formula

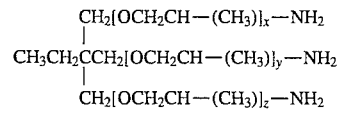

wherein the summation of x, y and z is about 5.3. The amount of branching monomer utilized is of from about 0.5 to about 6 percent by weight of polyimide.

A number of toner resins are known, such as styrene acrylates, styrene methacrylates, styrene-butadiene, polyesters, polyamides, polyimides generally, polyester imides, polyester amides and polyimide imine. Polyimide resins are known as high performance materials, such as summarized and illustrated in the *Encyclopedia of Polymer Science and Engineering,* 2nd Edition, Volume No. 12, published by Wiley (1985). Polyamic acid resins are also mentioned in the aforementioned *Encyclopedia*, see pages 364 and 365, wherein the polyamic acid is prepared as intermediate resin and then cyclized by the imidization process to result into the polyimide resins.

Polyimide resins for use as toner resins are known; for instance, in U.S. Pat. No. 5,348,830, there is disclosed a liquid crystalline polyimide based toner with low fixing temperatures.

The polyimide-imine toners of U.S. Pat. No 5,409793 possess low fixing temperature and are disclosed to be deinkable in embodiments in caustic aqueous conditions of from about a pH of 10 to about a pH of 14, and wherein the toner resin is believed to be decomposed to oligomers. Also, disclosed in U.S. Pat. No. 5,348,831 is a polyester-imide based toner with low fixing temperature, broad fusing latitude, good deinkability, such as in caustic conditions of from about 10 to about 14, and excellent nonvinyl offset properties. Other polyimide or polyimide-ester based toner resins are illustrated in U.S. Pat. Nos. 5,427,882, 5,411,829, 5,413,888, 5,427,881, 5,411,831 and 5,413,889, which discloses toners displaying one or more of the toner characteristics such as low fixing temperature, broad fusing latitude, low relative humidity sensitivity, nonvinyl offset and good deinkability such as in alkaline condition of pH of from about 10 to about 14 with the use of surfactant. The disclosures of each of the aforementioned copending patent applications and patents are totally incorporated herein by reference.

Polyamic acid resins for use as toners are also illustrated in copending application U.S. Ser. No. 394,869, filed currently herewith, the disclosure of which is totally incorporated herein by reference. This aforementioned polyamic acid application discloses toner which display low fixing temperatures, broad fusing latitude, nonvinyl offset properties, and more importantly, improved deinkability characteristics such as being dissolved or removed from paper at lower pH range, such as from about 8 to 10, without surfactants or with the use of ionic salts. Some specifics of the deinking process are disclosed in copending application U.S. Ser. No. 394,990, filed currently herewith, the disclosure of which is totally incorporated herein by reference. The process of deinkability is disclosed in the copending application U.S. Ser. No. 369,630, however, the relative humidity sensitivity of the aforementioned polyamic acid toners are from about 2.2 to about 6. It is believed that the amic acid moieties enhances deinkability at lower pH, such as from about 8 to 10, but is accompanied by a higher relative humidity sensitivity.

The disclosures of each of the copending patent applications and patents mentioned herein are totally incorporated herein by reference.

To maintain the enhanced deinkability properties such as that of the aforementioned polyamic acid in aqueous environments of pH of from about 8 to 10, while improving the relative humidity sensitivity properties of from about 1.2 to 3.0, such as disclosed in the aforementioned polyimide toner resin, and maintaining the other toner properties, such as low fixing temperature, broad fusing latitude, nonvinyl offset, nonblocking characteristics, the present invention provides polyimide-amic acid based toners; that is intermediate products obtained from the synthesis of polyimide resins from the same monomers utilized in the preparation of its polyamic precursors. The polyimide-amic acid based toners of this invention in embodiments possess the desired toner characteristics as well as improved deinkability, and low relative humidity sensitivity.

There is a need for an environmentally friendly toner, which after being fused onto paper or transparency, can be removed by conventional deinking process as practiced by the paper mill industries. More specifically, there is a need for deinking xerographic images comprised of toners containing a resin and pigment by a simple and effective process, such as alkaline pH of from about 8 to about 14, and preferably from about 8 to about 11 with small amounts of, or preferably no surfactants. These and other needs are achievable with the toners and resins of the present invention in embodiments.

SUMMARY OF THE INVENTION

Examples of objects of the present invention include:

It is an object of the present invention to provide toner and developer compositions with many of the advantages illustrated herein.

In another object of the present invention there are provided toner compositions with polyimide-amic acid, and which toners are useful for the development of electrostatic latent images including color images.

In yet another object of the present invention there are provided processes for the preparation of polyimide-amic acid by melt condensation methods.

Moreover, in another object of the present invention that are provided low melting toner compositions with rapid jetting rates, and wherein such toners avoid or minimize paper curl and enable high resolution developed images.

In another object of the present invention there are provided toners with low melt fusing temperatures of from about 130° C. to about 145° C., and a broad fusing latitude of from about 30° C. to about 60° C.

Moreover, in another object of the present invention there are provided toner compositions comprised of polyimide-amic acids with glass transition temperatures of from about 50° C. to about 65° C.

In yet another object of the present invention that are provided toner compositions comprised of polyimide-amic acids with a weight average molecular weight of from about 1,500 grams per mole to about 150,000 grams per mole as measured by GPC.

Moreover, it is an object of the present invention to provide toners which display excellent deinkability from paper at a pH of from about 8 to about 11.

Additionally, it is an object of the present invention to provide a toner which displays low relative sensitivity such as from about 1.0 to about 2.5 as measured from the triboelectric charge ratio at the 20 percent humidity level and 80 percent humidity level.

Another object of the present invention resides in the formation of toners which will enable the development of images in electrophotographic imaging and printing apparatuses, which images have substantially no background deposits thereon, are substantially smudge proof or smudge resistant, and, therefore, are of excellent resolution; and further, such toner compositions can be selected for high speed electrophotographic apparatuses, that is those exceeding 70 copies per minute.

Also, in another object of the present invention there are provided polyimide-amic acid resins comprised of additional organic moleties such as esters, imines, carbonates, thioesters, or mixtures thereof.

These and other objects of the present invention can be accomplished in embodiments thereof by providing toner compositions comprised of polyimide-amic acids such as illustrated by the formulas provided herein, and pigment particles. In embodiments, the present invention is directed to a toner composition comprised of pigment, and polyimide-amic with excellent deinkability, nonrelative humidity sensitivity, low fixing temperature, acceptable blocking characteristics, excellent flow, nonvinyl offset properties and broad fusing latitude.

The polyimide-amic acid resins of the present invention can be prepared as illustrated herein, and more specifically, by charging a reactor equipped with a bottom drain valve, double turbine agitator and distillation receiver with a cold water condenser with from about 0.95 to about 1.05 mole of dianhydride, such as 5-(2,5-dioxotetrahydrol)-3-methyl-3-cyclohexene-1,2-dicarboxylic anhydride I available as B-4400 from Dai Nippon Ink Chemical Company, and 0.95 to about 1.05 mole of a flexible diamine, such as a diamino-terminated polyoxypropylene available as JEFFAMINE D-230™ from Texaco Chemicals. The reactor is then stirred to about 50 revolutions per minute, whereby a exotherm is observed, resulting in a temperature increase of from room temperature up to about 50° C. The mixture is further heated to about 100° C., wherein the intermediate polyamic acid product is believed to be formed (Scheme 1). The mixture is then heated to about 145° C., whereby water is formed and collected in the distillation receiver, and there results the imidization of the amic acid moiety to the imide moiety (Scheme 1). On further heating to about 190° C., more water is collected until the desired conversion of amic acid to imide is achieved. For instance, when an imide conversion ratio of 50 percent is desired, for example, wherein the sum of ½ m and o is 50 mole percent of the resin, then the reaction is maintained above 140° C. to about 190° C. until about 50 mole equivalents of water are collected. The reaction is terminated by discharging the reaction product through the bottom drain valve into a container, preferably cooled by the use of dry ice. Furthermore, when high imide conversion is desired, such as over 85 percent or more, then the removal of water can be enhanced by optionally reducing the pressure of the reaction from atmospheric pressure to about 0.01 atmosphere.

Scheme 1

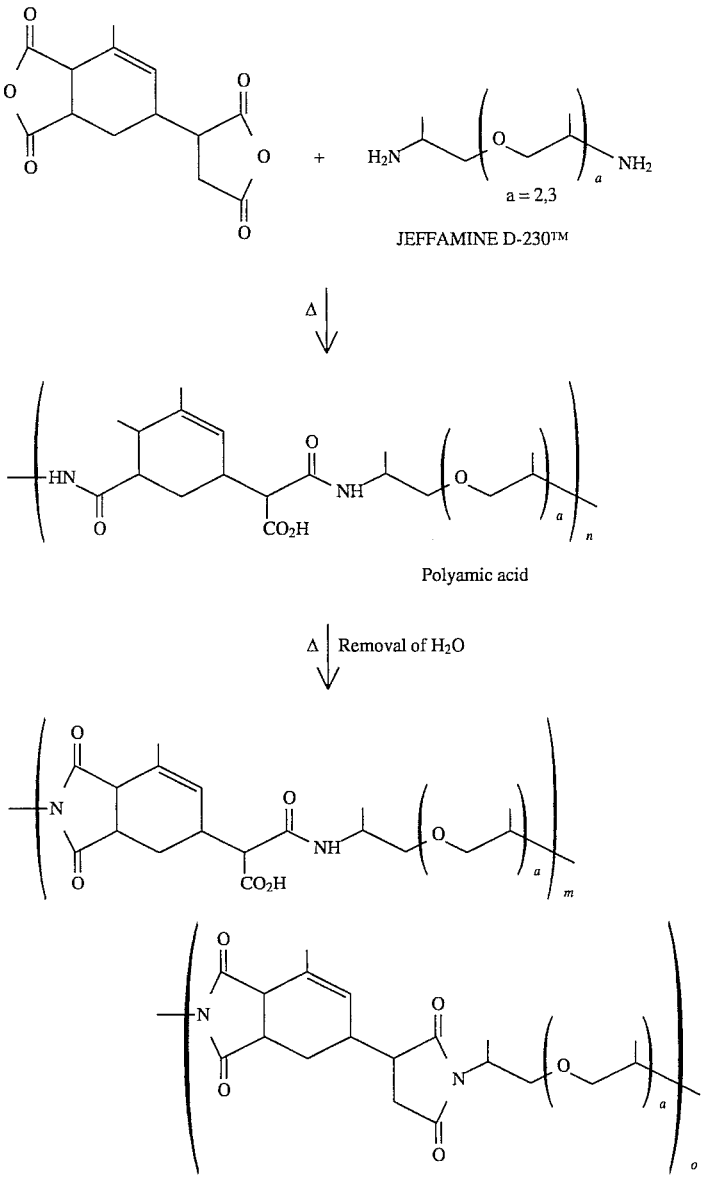

wherein the polyimide-amic acid is a combination (randomly) of segments m, n, and o; and the sum of m, n, and o is 100 mole percent.

The Polyimide-amic acid resin containing ester group of the present invention can be prepared as illustrated herein, and more specifically, by charging a reactor equipped with a bottom drain valve, double turbine agitator and distillation receiver with a cold water condenser with from about 0.45 to about 0.55 mole equivalent of a dianhydride, such as bis-1,2-(1'2'-phthaloanhydro-3-carboxy)-ethane (see Scheme 2), from about 0.45 to about 0.50 mole equivalent of a diamine, such as polyoxypropylene available as JEFFAMINE 230™ from Texaco Chemicals, and optionally a condensation catalyst such as dibutyltin oxide of from about 0.001 to about 0.04 mole percent. The reactor is then stirred at about 50 revolutions per minute, whereby an exotherm is observed and resulting in a temperature increase of from room temperature to about 60° C. The mixture is further heated to about 100° C., wherein the intermediate polyimide-amic acid product is believed to be formed (Scheme 2). The mixture is then heated to about 145° C., whereby water is formed and collected in the distillation receiver, and there results the imidization of the amic acid moiety to the imide moiety (Scheme 2). On further heating to about 190° C., more water is collected until the desired conversion of amic acid to imide is achieved. For example, when an imide conversion ratio of 50 percent is desired, for example wherein the sum of ½ p and r is 50 mole percent of the resin, then the reaction is maintained above 140° C. to about 190° C. until about 50 mole equivalents of water are collected. The reaction is terminated by discharging the reaction product through the bottom drain valve into a container, preferably cooled by the use of dry ice. Furthermore, when higher imide conversion is desired, such as about greater than 85 percent, such as 85 to 98, then water removal can be enhanced by optionally reducing the pressure of the reaction from atmospheric pressure to about 0.01 atmosphere.

Scheme 2

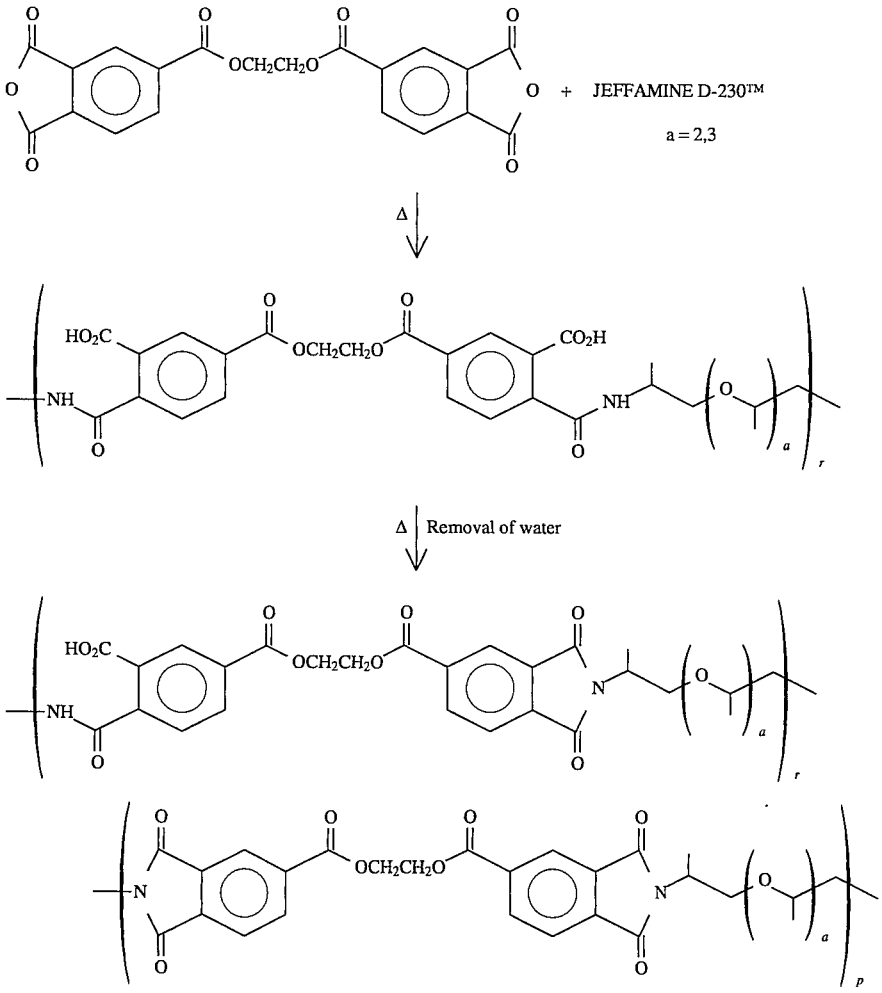

wherein the polyimide-amic acid is a combination (randomly) of segments p, q, and r provided that the sum of p, q, and r is 100 mole percent.

Specific examples of tetraacid or dianhydride monomers that can be utilized to prepare the polyimides of the present invention, include 5-(2,5-dioxotetrahydrol)-3-methyl-3-cyclohexene-1,2-dicarboxylic anhydride or the 5-(2,5-dioxotetrahydrol)-4-methyl-3-cyclohexene-1,2-dicarboxylic anhydride available as B-4400 and B-5060, respectively, from Dai Nippon Ink Chemical Company, pyromellitic dianhydride, pyromellitic tetracid, ethylenediamine dianhydride, benzophenone dianhydride, 3,3',4,4'-biphenyl tetracarboxylic dianhydride, 2,2'-bis-(3,4dicarboxyphenyl-)hexafluoropropane dianhydride, 4,4'-oxydiphthalic anhydride, 3,3',4,4'-diphenylsulfone tetracarboxylic dianhydride, 3,3',4,4'-benzophenone tetracarboxylic dianhydride, also known as benzophenone dianhydride, 3,3',4,4'-biphenyl tetracarboxylic dianhydride, 2,2'-bis-(3,4dicarboxyphenyl-)hexafluoropropane dianhydride, 4,4'-oxydiphthalic anhydride, 3,3',4,4'-diphenylsulfone tetracarboxylic dianhydride, 1,2,3,4 cyclopentane tetracid dianhydride, 1,2,4-trimellitic acid anhydride, 1,2,3-trimellitic acid, 1,2,3-cyclohexanetricarboxylic acid, 1,2,4-cyclohexanetricarboxylic acid, 2,5,7-naphthalenetricarboxylic acid, 1,2,4-butanetricarboxylic acid, mixtures thereof and the like. These monomers are selected in various effective amounts, such as from about 0.45 mole equivalent to about 0.55 mole equivalent.

Specific examples of diamino alkanes or diamino alkylene oxides that can be utilized to prepare the invention polyimides include diaminoethane, diaminopropane, 2,3-diaminopropane, diaminobutane, diaminopentane, diamino-2-methylpentane, also known as DYTEK A™ available from DuPont Chemical Company, diaminohexane, diaminotrimethylhexane, diaminoheptane, diaminooctane, diaminononane, diaminodecane, diaminododecane, diamino-terminated ethylene oxide, diamino-terminated diethylene oxide available as JEFFAMINE EDR-148™ from Texaco Chemicals, diamino-terminated diethylene oxide available as JEFFAMINE EDR-148™ from Texaco Chemicals, diamino-terminated triethylene oxide available as JEFFAMINE EDR-192™ from Texaco Chemicals, diamino-terminated polyoxypropylene oxide available from Texaco Chemicals as JEFFAMINE D-230™, JEFFAMINE 400™, JEFFAMINE 700™, mixtures thereof, and the like. This component is selected in various effective amounts such as from about 0.45 mole equivalent to about 0.55 mole equivalent of the polyimide resin.

Specific examples of branching agent that can be utilized to prepare the invention polyimides include glycerol, trimethylol ethane, trimethylol propane, pentaerythritol, sorbitol, diglycerol, diethylenetriamine, 1,2,4-triamino benzene, 1,2,3-triaminobenzene, or JEFFAMINE T-403™ available from Texaco Chemical Company, mixtures thereof and the like. The branching component is selected in various effective amounts such as from about 0.005 mole equivalent to about 0.08 mole equivalent of the polyimide-amic acid resin.

Specific examples of polycondensation catalysts can include tetraalkyl titanates, dialkyltin oxide, tetraalkyltin, dialkyltin oxide hydroxide, aluminum alkoxides, alkyl zinc, dialkyl zinc, zinc oxide, stannous oxide, dibutyltin oxide, butyltin oxide hydroxide, tetraalkyl tin such as dibutyltin dilaurate, mixtures thereof; and which catalysts are selected in effective amounts of from about 0.001 mole percent to about 0.01 mole percent of polyester product resin.

Various known colorants, especially pigments, present in the toner in an effective amount of, for example, from about 1 to about 25 percent by weight of toner, and preferably in an amount of from about 1 to about 10 weight percent that can be selected include carbon black like REGAL 330® magnetites, such as Mobay magnetites MO8029™, MO8060™; Columbian magnetites; MAPICO BLACKS™ and surface treated magnetites; Pfizer magnetites, CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and other equivalent black pigments. As colored pigments other than black there can be selected known cyan, magenta, yellow, red, green, brown, blue or mixtures thereof. Specific examples of pigments include HELIOGEN BLUE L6900™, D6840™, D7080™, D7020™, PYLAM OIL BLUE™ and PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™ and cyan, may also be selected as pigments, and are employed in effective amounts of from, for example, about 1 weight percent to about 50 weight percent of the toner.

The toner may also include known charge additives such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge additives like aluminum complexes, such as BONTRON E-88™, available from Orient Chemicals, and the like, and wherein the charge additive is present in the toner in amounts of, for example, from about 0.1 to about 5 weight percent.

Surface additives that can be added to the toner compositions of the present invention include, for example, metal salts, metal salts of fatty acids, colloidal silicas, polyvinylidenefluorides, tin oxides, titanium oxides, mixtures thereof and the like, which additives are usually present in an amount of from about 0.1 to about 1 weight percent, reference for example U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa Chemicals. Also, waxes, such as polypropylene and polyethylene, can be added to the toner in amounts of, for example, from about 0.1 to about 3 weight percent.

In another embodiment of the present invention there are provided, subsequent to known micronization and classification, toner with an average volume diameter of from about 5 to about 20 microns comprised of polyimide resin, pigment particles, and optional charge enhancing additives.

The polyimide-amic acid resin is present in a sufficient, but effective amount, for example from about 70 to about 95 weight percent. Thus, when 1 percent by weight of a charge enhancing additive is present, and 10 percent by weight of pigment or colorant, such as carbon black, is contained therein, about 89 percent by weight of resin is selected. Also, the charge enhancing additive may be coated on the pigment particles.

The toner and developer compositions of the present invention may be selected for use in electrostatographic imaging apparatuses containing therein known photoreceptors. Thus, the toner and developer compositions of the present invention can be used with layered photoreceptors, including flexible layered imaging members such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

Developer compositions include carrier particles, and the polyimide toners illustrated herein, examples of carriers being steel, iron, ferrites, silicon oxides, and the like with optional coatings, or an optional coating thereover, reference for example U.S. Pat. Nos. 4,937,166 and 4,935,326, the disclosures of which are totally incorporated herein by reference.

The following Examples are being provided to further define various species of the present invention, and these Examples are intended to illustrate and not limit the scope of the present invention. Parts and percentages are by weight unless otherwise indicated. Comparative Examples and data are also provided.

EXAMPLE I (COMPARATIVE)

A polyamic acid resin derived from 5-(2,5-dioxotetrahydrol)-3-methyl- 3-cyclohexene-1,2-dicarboxylic anhydride and diamino-terminated polyoxypropylene with an average molecular weight of 230 and available as JEFFAMINE D-230™ from Texaco Chemical Company was prepared as follows.

To a 7.6 liter Parr reactor equipped with a two blade turbine stirrer and a thermocouple were added 1,568 grams (6.82 moles) of JD 230™ (Texaco Chemicals) and 320 grams (0.8 mole) of JD-400™ (Texaco Chemicals). This mixture was stirred at 100 rpm while 2,000 grams (7.7 moles) of 5-(2,5-dioxotetrahydrol)-3-methyl-3-cycloxexene-1,2-dicarboxylic anhydride (B-4400, Dai Nippon Ink Company) were added. An exotherm is observed which heats up the reaction mixture from 20° C. to 59° C. The reactor was sealed and heated to 75° C. Once the reaction reached 75° C., a second exotherm occurred raising the reaction temperature to 145° C. The reaction was stirred for 30 minutes to complete the reaction and then discharged and cooled. The glass transition temperature of the resin product was measured to be 61° C. using the E. I. DuPont Differential Scanning Calorimeter at 10° C. per minute, and the molecular properties measured by gel permeation chromatography using tetrahydrofuran as the solvent and polystyrene as the calibration standard. The number average molecular weight was found to be 4,100 and the weight average molecular weight was found to be 8,600. Softening point of the product, as measured on a Mettler Sofenting Point Instrument, was 120° C.

EXAMPLE II to EXAMPLE V

General procedure for the preparation of a polyamic acid imide resin derived from 5-(2,5-dioxotetrahydrol)-3-methyl-3-cyclohexene-1,2-dicarboxylic anhydride and diamino-terminated polyoxypropylene with an average molecular weight of 230 and available as JEFFAMINE D-230 ™ from Texaco Chemical Company was prepared as follows.

A mixture of 5-(2,5-dioxotetrahydrol)-3-methyl-3-cyclohexene-1,2-dicarboxylic anhydride (113 grams) and JEFFAMINE D-230™ (81 grams) was charged into a 300 milliliter Parr reactor equipped with a mechanical stirrer, distillation receiver and bottom valve drain. The resulting mixture was heated to 150° C. and stirred for 30 minutes, followed by increasing the temperature to 175° C. whereby water started to distill. The mixture was then maintained at 175° C. until the desired amount of water was removed, specified as percent conversion, and calculated by dividing half the number of moles of water collected by the number of moles of resin obtained times 100 percent (Table 1 for Examples II, III, IV and V). The reaction was then increased, purged with nitrogen and discharged through the bottom drain of the reactor. The glass transition temperature of the resin product was measured using the E. I. DuPont Differential Scanning Calorimeter at 10° C. per minute, and the molecular properties measured by gel permeation chromatography using tetrahydrofuran as the solvent and polystyrene as the calibration standard.

TABLE 1

| Polyimide-amic Acid Resins | | | | |
|---|---|---|---|---|
| | Percent | | GPC | |
| Example | Conversion | Tg | $M_n$ | $M_w$ |
| II | 25 | 60 | 4,000 | 8,200 |
| III | 55 | 59 | 3,800 | 7,950 |
| IV | 75 | 58 | 3,700 | 7,750 |
| V | 85 | 58 | 3,500 | 7,700 |

EXAMPLE VI (COMPARATIVE)

A polyimide resin derived from 5-(2,5-dioxotetrahydrol)-3-methyl-3 -cyclohexene-1,2-dicarboxylic anhydride and diamino-terminated polyoxypropylene with an average molecular weight of 230 and available as JEFFAMINE D-230™ from Texaco Chemical Company was prepared as follows.

A mixture of 5-(2,5-dioxotetrahydrol)-3-methyl-3-cyclohexene-1,2-dicarboxylic anhydride (113 grams) and JEFFAMINE D-230™ (81 grams) was charged into a 300 milliliter Parr reactor equipped with a mechanical stirrer, distillation receiver and bottom valve drain. The resulting mixture was heated to 150° C. and stirred for 30 minutes, followed by increasing the temperature to 175° C. whereby water started to distill. The mixture was then maintained at 175° C. for 2 hours whereby more water was collected. The reactor temperature was then increased to 210° C., and the pressure was reduced to about 0.5 torr over a two hour period. The total amount of water collected by distillation was 12.5 grams (98.5 percent conversion). The bottom drain of the reactor was then opened, and the polyimide resin, poly(5-(2,5-dioximide-tetrahydrol)-3-methyl-3-cyclohexene-1,2-dicarboxylimide-N-propyleneoxypropylene), was allowed to pour into a container cooled with dry ice, and measured to be 175 grams. The glass transition temperature of the resin product was measured to be 55° C. using the E. I. DuPont Differential Scanning Calorimeter at 10° C. per minute, and the molecular properties measured by gel permeation chromatography using tetrahydrofuran as the solvent and polystyrene as the calibration standard. The number average molecular weight was found to be 8,100 and the weight average molecular weight was found to be 18,000.

EXAMPLE VII to XII

General procedure for the preparation of toner composition comprised of 95 percent by weight of the resin and 5 percent by weight of REGAL 330® pigment was prepared as follows.

REGAL 330® (5 grams) and the polymeric resin (Table 2) (114° C.) were dry blended using a Black and Decker coffee grinder. A small CSITM counter rotating twin screw extruder, available from Customs Scientific Instrumentations, was then used to melt mix the mixture at a barrel temperature of 140° C., screw rotational speed of 50 rpm, and at a feed rate of 0.5 gram per minute. The extruded strands were then broken up into coarse particles using the Black and Decker coffee grinder, and the particle size further reduced in a 2 inch Sturtevant micronizer. After grinding, the toner average volume diameter particle size (Table 2) was measured by the Coulter Counter Microsizer II®, available from Coulter Electronics Inc. The resulting toner was then utilized without further classification. A developer composition was prepared by roll milling the aforementioned toner, 3 parts by weight with 100 parts by weight of Xerox Corporation 9200 carrier particles comprised of a ferrite core coated with a terpolymer of methylmethacrylate, styrene, and vinyltriethoxy silane, which coating is commercially available. The tribo data (Table 2) was obtained using the known blow-off Faraday Cage apparatus, and the toner developer was subjected to both 20 percent and 80 percent humidity in a chamber for 48 hours. The relative humidity (Table 2) was measured as the ratio of the corresponding triboelectric charge at 20 percent RH to 80 percent RH. Unfused copies were then produced with a customized Xerox Corporation MAJESTIK™ test copier with the fusing system disabled at a room relative humidity of about 50 percent. The unfused copies were then imaged with a customized Xerox Corporation 1075 copier and the fusing results measured with a Xerox Corporation 1075 fuser. The deinkability of fused toner images on paper were assessed by soaking the image in a tray comprised of an aqueous mixture of 5 percent TRITTON X-100™ nonionic surfactant, and sufficient sodium hydroxide to adjust the pH to about 10. This deinkability assessment (Table 2) was performed visually by recording the amount of time necessary for the image to dissolve away from the paper.

TABLE 2

| | | Toner Performance | | | | | |
|---|---|---|---|---|---|---|---|
| | | Tribo Charge Microcoulombs Per Gram | | | MFT | Hot-Offset | Deink-ability |
| Example | Resin | 20% RH | 80% RH | RH | °C. | °C. | (minutes) |
| VII | Comparative Example I | −20 | 3.5 | 5.7 | 135 | 180 | 10 |
| VIII | Example II | 18 | 5.0 | 3.6 | 134 | 180 | 15 |
| IX | Example III | 16 | 5.2 | 3.1 | 133 | 180 | 15 |
| X | Example IV | 15 | 5.2 | | 131 | 175 | 20 |
| XI | Example V | 12 | 5.5 | 2.2 | 135 | 180 | 35 |
| XII | Comparative Example VI | 11 | 5.5 | 2.0 | 135 | 180 | 80 |

Comparative Example VI, comprised of a polyamic acid resin, resulted in excellent deinkability (time=10 minutes) but with unacceptable relative humidity property (RH=5.7). The comparative Example XII, comprised of a polyimide resin, resulted in poorer deinkability (time=80 minutes), but with excellent relative humidity property (RH=2). The toners of the present invention, Examples VII to XI and comprised of polyamic acid imide resin, resulted in acceptable relative humidity (RH=2.2) to and good deinkability time of 15 to 35 minutes.

Other embodiments and modifications of the present invention may occur to those skilled in the art subsequent to a review of the present application and the information presented herein; these embodiments and modifications, as well as equivalents thereof, are also included within the scope of this invention.

What is claimed is:

1. A toner composition consisting essentially of a pigment and a polyimide-amic acid resin.

2. A toner composition in accordance to claim 1 wherein the polyimide-amic acid resin is comprised of at least one imide moiety, and an equal amounts of at least one carboxylic acid moiety and at least one amide moiety.

3. A toner composition in accordance to claim 1 wherein the polyimide-amic acid resin is branched, crosslinked, or zwitterionic.

4. A toner composition in accordance with claim 1 wherein the polyimide-amic acid resin is represented by the formula.

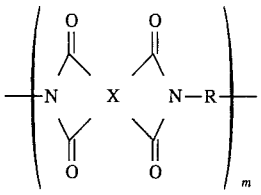

-continued

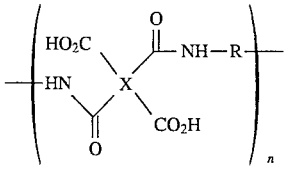

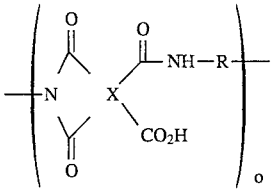

wherein m, n, and o represents random segments, and m is from about 0 to 99 mole percent of the resin, n is from about 0 to 99 mole percent of the resin, and o is from about 1 to 100 mole percent of the resin, and the sum of m, n and o is 100 mole percent of the resin; X is a tetrasubstituted aromatic or aliphatic moiety each with from about 5 to 36 carbon atoms, and R' is an alkylene, alkyleneoxyalkylene, or poly(alkyleneoxy)alkylene.

5. A toner composition in accordance with claim 3 wherein the branching of the polyimide-amic acid resin is accomplished with a multifunctional monomer.

6. A toner composition in accordance with claim 5 wherein the multifunctional monomer is the trifunctional monomer diethylenetriamine, dipropylenetriamine, and triamine of the formula

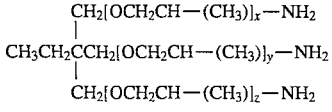

selected in amounts of from about 0.005 to about 0.2 mole percent by weight of polyimide-amic acid, and wherein x, y and z are equal to about 5.3.

7. A toner composition in accordance with claim 4 wherein R' is selected from the group consisting of methylene, ethylene, propylene, butylene, pentylene, hexylene, heptylene, octylene, nonyl, decylene, undecylene, dodecylene, stearylene, laurylene, ethyleneoxyethylene, propyleneoxypropylene, butyleneoxybutylene, ethyleneoxyethylene oxyethylene, ethyleneoxyethyleneoxyethylene oxyethylene and propyleneoxypropylene oxypropylene.

8. A toner composition in accordance with claim 4 wherein X is a tetrasubstitued aromatic moiety derived from benzene, benzophenone, phenyleneoxyphenylene, phenylene-2-hexafluoropropylene-phenylene, anthralene, perylene, bisphenol, a tetrasubstitued aliphatic moiety derived from cyclohexane, or ethylenediamine tetramethylene.

9. A toner composition in accordance with claim 4 wherein X is a tetrasubstituted aromatic moiety of the formula

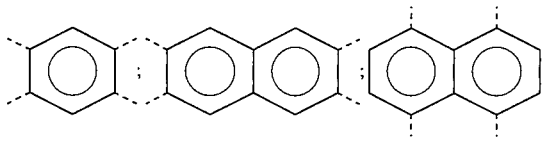

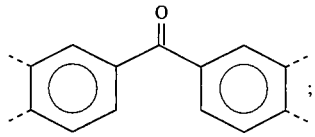

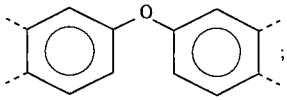

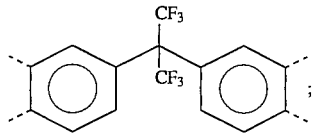

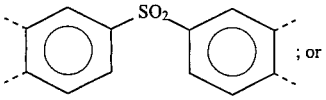

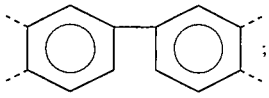

wherein the dotted lines represent bonds from the substituent site.

10. A toner composition in accordance with claim 4 wherein X is a tetrasubstituted aliphatic moiety of the formula

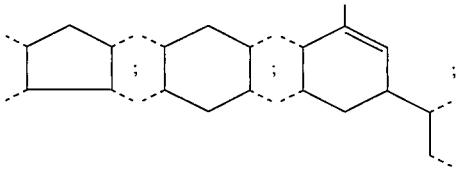

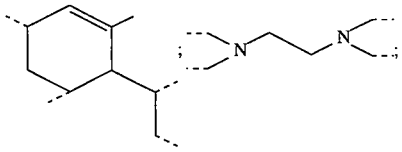

-continued

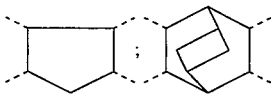

11. A toner composition in accordance with claim 1 wherein the polyimide-amic acid has a number average molecular weight $M_n$ of from about 1,500 to about 20,000, a weight average molecular weight $M_w$ of from about 2,500 to about 100,000, and a polydispersity of from about 1.5 to about 10.

12. A toner composition in accordance with claim 1 which possesses a low fixing temperature of from about 120° C. to about 145° C. and a broad fusing latitude of from about 40° C. to about 120° C.

13. A toner composition in accordance with claim 1 wherein the polyimide-amic acid is obtained from the reaction of from about 0.40 mole equivalent to about 0.55 mole equivalent of a dianhydride, and from about 0.40 mole equivalent to about 0.55 mole equivalent of a diamine, and optionally of from about 0.01 to about 0.2 mole percent of a branching monomer.

14. A toner composition in accordance with claim 13 wherein the dianhydride is selected from the group consisting of 5-(2,5-dioxotetrahydrol)- 3-methyl-3-cyclohexene-1, 2-dicarboxylic anhydride or 5-(2,5-dioxotetrahydrol)-4-methyl-3-cyclohexene-1,2-dicarboxylic anhydride), and mixtures thereof.

15. A toner composition in accordance with claim 13 wherein the diamine is selected from the group consisting of diaminoethane, diaminopropane, 2,3-diaminopropane, diaminobutane, diaminopentane, diamino-2-methylpentane diaminohexane, diamino-trimethylhexane, diaminoheptane, diaminooctane, diaminononane, diaminodecane, diaminododecane, diamino-terminated diethyleneoxide, diamino-terminated triethyleneoxide, and a polyoxyalkylene of the formula

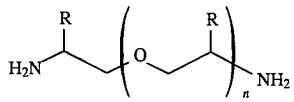

wherein R represents a hydrogen or alkyl group, and n represents the number of monomer segments and is a number of from about 1 to about 10.

16. A toner composition in accordance with claim 1 with a glass transition temperature thereof of from about 50° C. to about 65° C., and a relative humidity sensitivity of from about 1.01 to about 2.3.

17. A toner composition in accordance with claim 1 further including a charge enhancing additive incorporated into the toner, or present on the surface of the toner, further containing a wax component with a weight average molecular weight of from about 1,000 to about 10,000, and optionally further containing as external additives metal salts of a fatty acid, colloidal silicas, or mixtures thereof.

18. A toner composition in accordance with claim 1 wherein the pigment is carbon black, magnetites, or mixtures thereof, cyan, magenta, yellow, red, blue, green, brown, or mixtures thereof.

19. A developer composition comprised of the toner composition of claim 1 and carrier particles.

20. A developer composition in accordance with claim 19 wherein the carrier particles are comprised of ferrites, steel, or an iron powder with an optional coating, or mixture of coatings thereover.

21. A method of imaging which comprises formulating an electrostatic latent image on a photoconductive imaging member, affecting development thereof with the toner composition of claim 1, and thereafter, transferring the developed image to a suitable substrate.

22. A toner composition in accordance with claim 1 wherein the polyimide-amic acid resin is represented by the formula

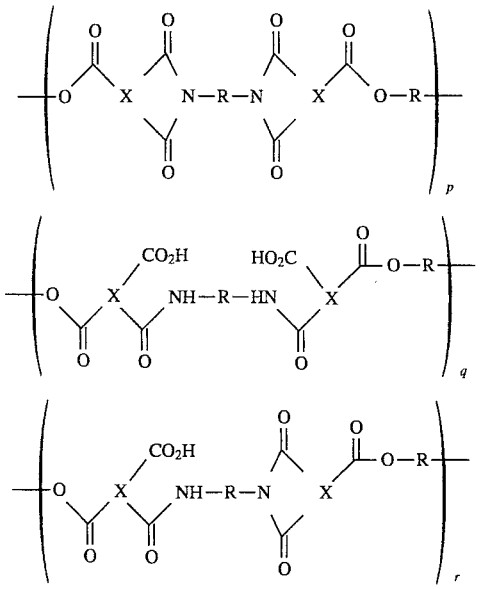

wherein p, q, and r represent random segments, and p is from about 0 to 99 percent, q is from about 0 to 99 percent, r is from about 1 to 100 percent, and the sum of p, q and r is 100 percent; X is a trisubstituted aromatic or aliphatic moiety with from about 5 to 36 carbon atoms; and R is an alkylene, alkyleneoxyalkylene, or poly(alkyleneoxy)alkylene.

23. A toner composition in accordance with claim 22 wherein the trisubstituted X moiety is a benzene moiety of the formula

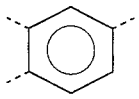

wherein the dotted lines represent bonds from the substituent site.

24. A toner composition in accordance with claim 22 wherein the n and o segments of the polyimide-amic acid are represented as a zwitterionic structure of the formula

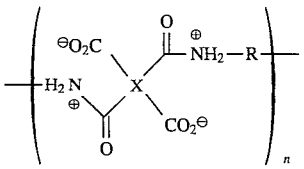

-continued

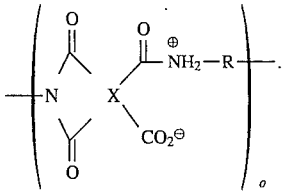

25. A toner composition in accordance with claim 22 wherein the q and r segments of the polyimide-amic acid are represented as a zwitterionic structure of the formula

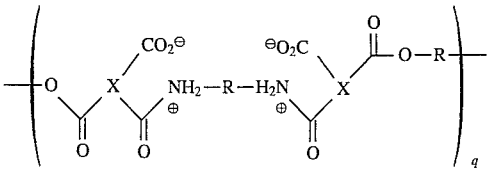

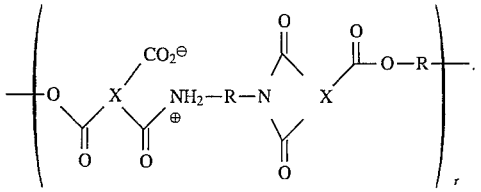

26. A toner composition in accordance with claim 1 wherein the polyimide-amic acid is obtained from the reaction of from about 0.40 mole equivalent to about 0.55 mole equivalent of an acid dianhydride or triacid, from about 0.20 mole equivalent to about 0.25 mole equivalent of a diamine, and from about 0.20 mole equivalent to about 0.25 mole of a diol.

27. A toner composition in accordance with claim 26 wherein the acid dianhydride is 1,2,3-trimellitic acid anhydride.

28. A toner composition in accordance with claim 26 wherein the diamine is selected from the group consisting of diaminoethane, diaminopropane, 2,3-diaminopropane, diaminobutane, diaminopentane, diamino-2-methylpentane, diaminohexane, diamino-trimethylhexane, diaminoheptane, diaminooctane, diaminononane, diaminodecane, diaminododecane, diamino-terminated diethyleneoxide, diamino-terminated triethyleneoxide, and a polyoxyalkylene of the formula

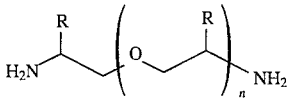

wherein R represents a hydrogen or alkyl group, and n represents the number of monomer segments and is a number of from about 1 to about 10.

29. A toner composition in accordance with claim 26 wherein the diol is selected from the group consisting of 1,2-ethanediol, 1,2-propanediol, 1,3-propanediol, 1,4-butanediol, 1,3-butanediol, 1,6-hexanediol, 2,2-dimethylpropanediol, 2-methylpropanediol, diethylene glycol, triethylene glycol, tetraethylene glycol, polyethylene glycol, dipropylene glycol, tripropylene glycol, and poly-propyleneglycol.

30. A toner composition comprised of a pigment and a polyimide-amic acid resin wherein the polyimide-amic acid resin is comprised of at least one imide moiety, and equal amounts of at least one carboxylic acid moiety and at least one amide moiety; and wherein said polyimide-amic acid has a number average molecular weight $M_n$ of from about 1,500 to about 20,000, a weight average molecular weight $M_w$ of from about 2,500 to about 100,000, and a polydispersity of from about 1.5 to about 10.

31. A toner composition consisting essentially of a pigment and a polyimide-amic acid resin wherein the polyimide-amic acid resin consists essentially of at least one imide moiety, and equal amounts of at least one carboxylic acid moiety and at least one amide moiety; and wherein said polyimide-amic acid has a number average molecular weight $M_n$ of from about 4,000 grams per mol to about 6,000 grams per mol, a weight average molecular weight $M_w$ of from about 10,000 grams per mol to about 150,000 grams per mol, and wherein the ratio of weight average molecular weight to number average molecular weight $M_w/M_n$ is from about 1.5 to about 3.

32. A toner composition in accordance with claim 30 wherein the polyimide-amic acid resin is derived from the reaction of 5-(2,5-dioxotetrahydrol)-3 -methyl-3-cyclohexene-1,2-dicarboxylic anhydride and diamino-terminated polyoxypropylene.

33. A toner composition consisting of a pigment and a polyimide-amic acid resin.

* * * * *